US005675937A

United States Patent [19]

Stebel

[11] Patent Number: 5,675,937

[45] Date of Patent: Oct. 14, 1997

[54] TILT ASSIST DEVICE FOR TILT WINDOWS

[75] Inventor: Robyn P. Stebel, Urbana, Ill.

[73] Assignee: Jeld-Wen, Inc., Klamath Falls, Oreg.

[21] Appl. No.: 735,850

[22] Filed: Oct. 23, 1996

[51] Int. Cl.[6] ..... E05D 13/00

[52] U.S. Cl. ..... 49/453; 49/428

[58] Field of Search ..... 49/161, 176, 414, 49/415, 416, 423, 428, 453, 454

[56] References Cited

U.S. PATENT DOCUMENTS

| | | | |
|---|---|---|---|
| 3,235,916 | 2/1966 | Dunsmoor et al. | 20/52.4 |
| 3,464,160 | 9/1969 | Anderson | 49/181 |
| 4,122,633 | 10/1978 | Holdiman | 49/501 |
| 4,922,656 | 5/1990 | Giguere | 49/161 |
| 5,265,308 | 11/1993 | May et al. | 16/197 |
| 5,544,450 | 8/1996 | Schmidt et al. | 49/419 |
| 5,566,507 | 10/1996 | Schmidt et al. | 49/181 |

FOREIGN PATENT DOCUMENTS

| | | | |
|---|---|---|---|
| 970649 | 9/1964 | United Kingdom | 49/423 |

*Primary Examiner*—Kenneth J. Dorner
*Assistant Examiner*—Jerry Redman
*Attorney, Agent, or Firm*—Charles D. McClung, Esq.; Chernoff, Vilhauer, McClung & Stenzel LLP

[57] ABSTRACT

A tilt window assembly including a window frame having a flexible jamb liner; a sliding sash including a laterally outwardly extending projection; a tilt lock mechanism connecting the sliding sash with jambs in the window frame; and a tilt assist embossment attached to the jamb liner. The tilt assist embossment facilitates tilting of the sash interiorly for cleaning.

14 Claims, 4 Drawing Sheets

TILT ASSIST DEVICE FOR TILT WINDOWS

FIELD OF THE INVENTION

The present invention relates to tilt windows which are characterized by window sash structures and associated hardware enabling pivotal movement of the sash out of the window plane, usually from a vertical position to an angularly disposed position. The tilt feature facilitates cleaning and maintenance of the window sash.

BACKGROUND OF THE INVENTION

Tilt window assemblies are known in the prior art. Some references disclosing tilt windows are Dunsmoor et al. U.S. Pat. No. 3,235,916; Anderson U.S. Pat. No. 3,464,160 and Giguere U.S. Pat. No. 4,922,656.

Prior art tilt window assemblies usually include a tilt lock mechanism associated with a lower rail of a glazed window sash. The tilt lock mechanism may include pivotal cam shafts fixed to the lower rail and inserted into openings in a sliding shoe member which slides vertically in a track defined by the jamb liner. Upon pivotal deflection of the sash frame, the cam shafts engage the opening to drive friction engagement elements of the sliding shoe into fixed contact with the track, thereby locking the lower rail into a fixed position.

The upper rail of the sliding sash is released from engagement with the jamb liner by manually forcing the jamb liner laterally outwardly so that a projection on the sash can be deflected laterally inwardly from a jamb liner channel in which the projection normally rides. After one projection is released from its channel, a second projection on the opposite lateral side is released by a similar procedure. When both projections are released, the sash is tilted by pulling the upper rail toward the interior while the lower rail is fixed in position by the lock mechanism described above. The window sash is thereby deflected into a position in which an exterior pane of the sash glazing is accessible for cleaning or other maintenance.

Although these prior art window assemblies are capable of operating as intended, some users have great difficulty in applying sufficient manual force to flex the jamb liners laterally outwardly. Accordingly, there is still a need for a tilt window assembly in which reduced manual force is needed to perform this task.

It is a principal objective of the present invention to provide a tilt window assembly that is more easily manipulated than prior art tilt window assemblies.

A related objective of the invention is to provide a window assembly having a tilt assist embossment for facilitating pivotal movement of a window sash out of locking engagement with the flexible jamb liners.

A further objective of the invention is to provide a tilt assist embossment which can either be installed as original equipment in new window assemblies or retrofitted into previously installed window assemblies.

Additional objectives and advantages of our invention will become apparent to persons skilled in the art from the detailed description that follows.

SUMMARY OF THE INVENTION

In accordance with the present invention, there is provided a tilt window assembly comprising a window frame having flexible jamb liners, a sliding sash, and a tilt lock mechanism. In order to facilitate tilting of the sliding sash for cleaning or maintenance, the jamb liners are provided with tilt assist embossments.

The window frame has a pair of opposed jambs each comprising a flexible jamb liner having a side wall and an elongated channel. The jamb liner is preferably made from a flexible polymeric material such as extruded polyvinyl chloride ("vinyl"). The channel is preferably formed integrally in the jamb liner and includes an outer wall spaced laterally outwardly of the side wall. The window frame preferably also includes a generally horizontally extending sill.

The sliding sash may be made of wood, vinyl or metal and is preferably wood having an exterior aluminum alloy cladding. The sash has a frame made up of upper and lower rails joined by opposed stiles, all supporting one or more glass glazing panes. The frame further includes a side portion and a projection extending laterally outwardly of the side portion into the channel of the jamb liner. The sash slides in the channel, usually upwardly and downwardly.

A tilt lock mechanism connects the jambs with the sliding sash. This mechanism preferably includes pivotal cam shafts fixed to the lower rail and inserted into openings in sliding shoe members which slide along tracks defined by the jamb liner. When the sash frame is pivotably deflected from its locked position, the cam shafts engage their respective openings to drive the sliding shoes into frictional engagement with their tracks, thereby locking the lower rail into a fixed position.

The tilt assist embossment of the invention is attached to the channel, preferably to its outer wall. For example, a particularly preferred molded nylon embossment includes an integrally formed fastener which extends into and locks with a through opening in the channel outer wall. The most preferred embodiment also includes an outer wall portion adjacent the channel outer wall; an inner wall portion spaced laterally inwardly of the outer wall portion; and a ramp extending angularly between the outer and inner wall portions.

In a particularly preferred window assembly, the sliding sash is slid upwardly so that the projection abuts against the embossment inner wall portion. The embossment reacts to contact with the projection by flexing the jamb liner laterally outwardly. As a result, it is easier to unlock the projection from the channel by pulling on the sash upper rail than in window assemblies of the prior art. The sash is thereby tilted toward the interior, with the lower rail locked to the jamb liners by the tilt lock mechanism.

DETAILED DESCRIPTION OF A PREFERRED EMBODIMENT

Figure 1:
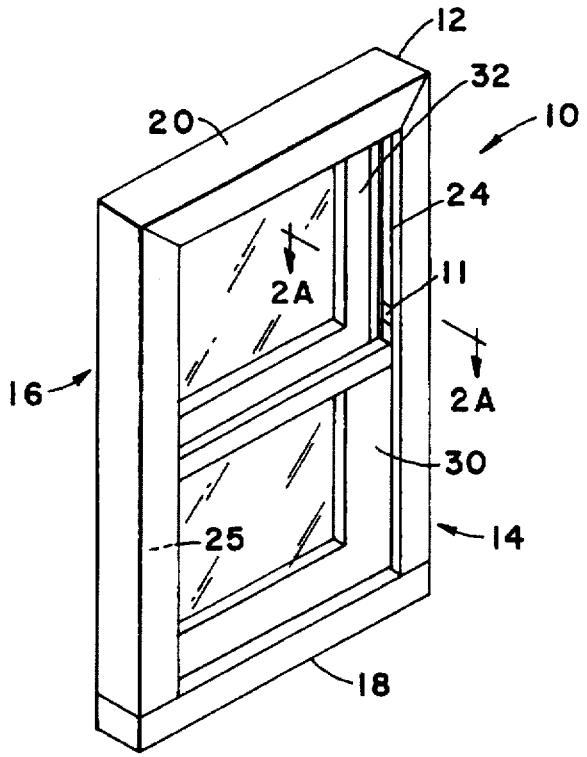
FIG. 1 is a perspective view of a tilt window assembly of the present invention.

In FIG. 1 there is shown a tilt window assembly 10 embodying a tilt assist embossment 11 of the present invention.

Figure 2A:
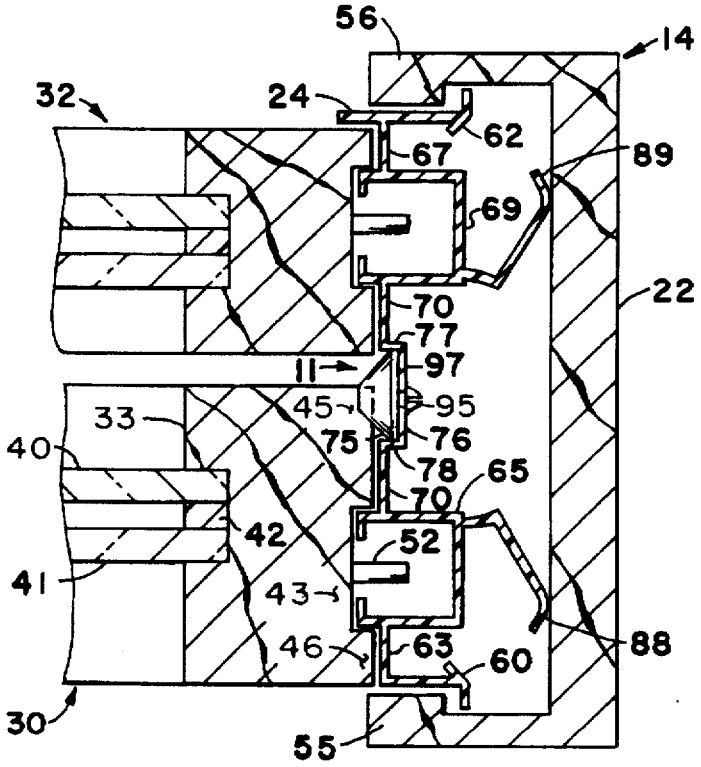
FIG. 2A is a fragmentary cross-sectional view, taken along the lines 2—2 of FIG. 1.

The tilt window assembly 10 includes a window frame or window casing 12 having a pair of opposed, generally vertical first and second jambs 14, 16 joined by a generally horizontal sill 18 and a generally horizontal top piece 20. As shown in FIG. 2A, the first jamb 14 comprises a wood jamb side 22 supporting a first flexible jamb liner 24. The second jamb 16 supports a second jamb liner 25.

Figure 5:
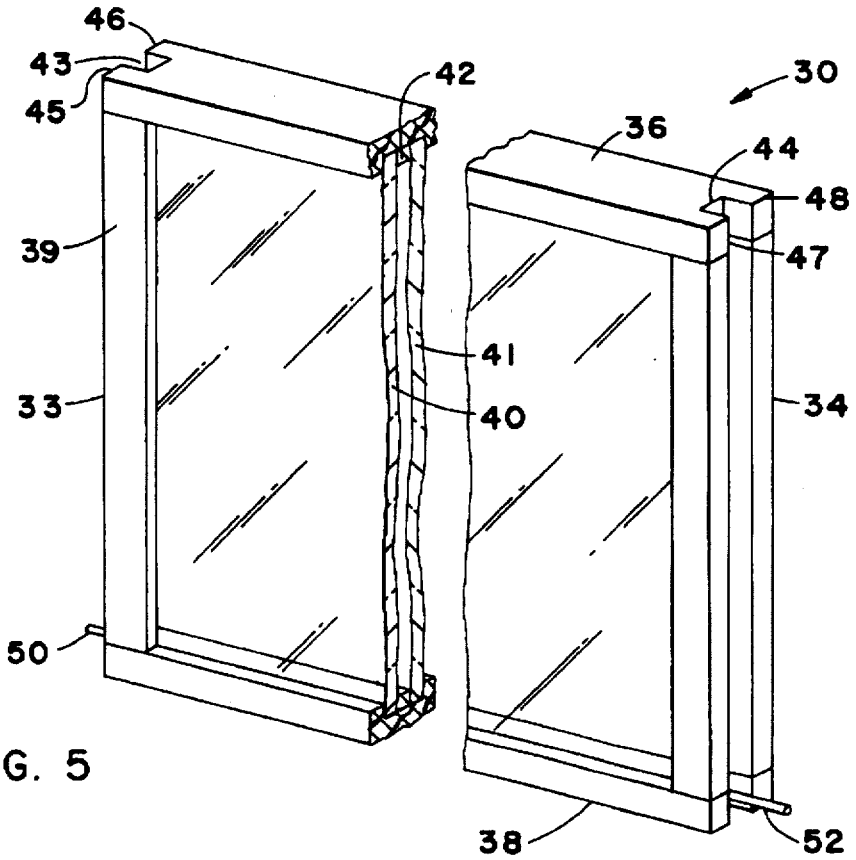
FIG. 5 is a perspective view of a glazed window sash for the tilt window assembly of the invention.

The window assembly 10 is a double hung assembly, having a lower sliding sash 30 and an upper sliding sash 32. As shown in FIG. 5, the lower sliding sash 30 has two upright wood stiles 33, 34 which are substantially parallel to each other and receive an upper rail or top rail 36 and a lower rail or bottom rail 38 at their ends to form a joint. Double glazing panels 40, 41 are resiliently cushioned against the stiles 33, 34 and rails 36, 38 by a glazing gasket 42. The glazing panels 40, 41 may be glass or plastic and are preferably two panes of glass separated by a spacer to form an insulated window.

Exterior portions of the stiles 33, 34 and rails 36, 38 are preferably covered by metal cladding 39. The cladding preferably consists of aluminum alloy extrusions having portions folded over end portions of the stiles 33, 34 and rails 36, 38. The metal clad sash is described in greater detail in Holdiman U.S. Pat. No. 4,122,633, the disclosure of which is incorporated herein by reference, to the extent consistent with the present invention.

The particularly preferred sash 30 shown in FIG. 5 has stiles 33, 34 including sides or side portions 43, 44. One side portion 43 has respective exterior and interior projections 45, 46 extending laterally outwardly thereof, and the opposite side portion 44 similarly has two lateral projections 47, 48.

The sash lower rail 38 supports two laterally outwardly directed cam shafts 50, 52. The cam shafts 50, 52 are part of a tilt lock mechanism connecting the lower sash 30 with the jamb liners 24, 25.

Figure 4:
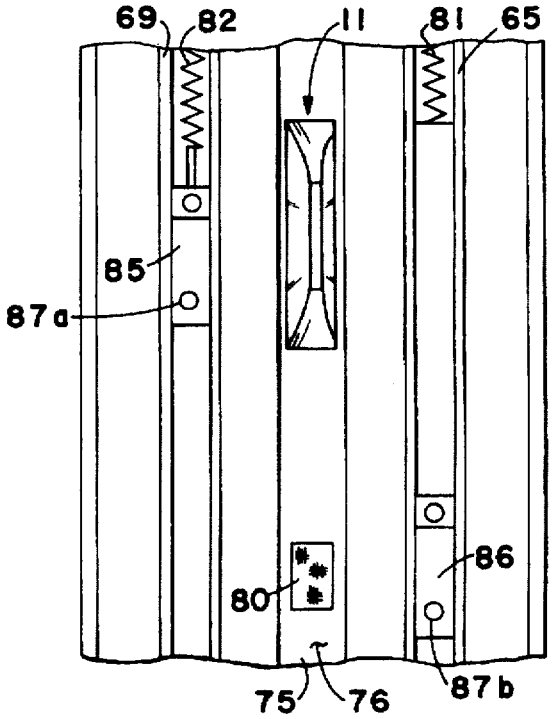
FIG. 4 is a fragmentary elevational view, taken along the lines 4—4 of FIG. 2B, with both sashes removed.

Referring now to FIGS. 2A and 4, there is shown a flexible jamb liner 24 of the invention. In the preferred embodiment shown, the jamb liner 24 is extruded from a plastic material such as polyvinyl chloride ("vinyl" or "PVC") that is at least semi-rigid. Rigidity depends not only upon the material from which the jamb liner is extruded, but its configuration and wall thickness as well. A typical wall thickness for the jamb liner 24 is about 0.045 inches. The jamb liner 24 has a length and width chosen to correspond with the side of the window jamb in which it is installed. The jamb liner typically fits into an associated jamb side and overlies it.

As shown in FIG. 2A, the jamb liner 24 is retained by an interior abutment or stop 55 and an exterior abutment or stop 56. The stops 55, 56 may be removable to facilitate installation of the jamb liner 24.

The jamb liner 24 is specifically designed for use with a double hung window and is configured to receive and guide a pair of slideable windows or sashes 30, 32. The jamb liner 24 includes an interior edge member 60 adjacent interior stop 55, and an exterior edge member 62 adjacent exterior stop 56.

A first web 63 connects the interior edge member 60 with a first track or guide way 65 having a square cross-section. A second web 67 connects the exterior edge member 62 with a second track or guide way 69 also having a square cross-section. The two tracks 65, 69 are connected by a side or side wall 70.

The side wall 70 has a stepped configuration defining a channel or groove 75 having an outer wall 76 and connecting walls 77, 78. The channel 75 may receive a short length of carpet like weather-stripping material 80 adjacent a top rail of the lower sash 30, which acts as a seal between the sash 30 and jamb liner 14.

The tracks 65, 69 each house an elongated coil spring 81, 82 suspended from the top of the tracks 65, 69 by a clip (not shown). Plastic shoes 85, 86 are suspended from bottom ends of the springs 65, 69, as shown in FIG. 4. The sliding shoes 85, 86 each define an opening **87*a*, 87*b* which will hold cam shafts 50, 52 extending from the window sash 30, 32. The shoes 85, 86 slide freely in the tracks 65, 69 when the sashes are in their usual vertical position. However, when the sash 30, 32 are tilted interiorly, the cam shafts 50, 52** engage their respective openings to drive the sliding shoes into frictional engagement with walls of the tracks, thereby locking the lower rail into a fixed position in which the sash can be neither raised nor lowered.

The force exerted by the springs 81, 82 varies as a function of their extension. In order to maintain more constant force on the sash, means are provided for applying frictional force between the jamb liner 24 and the sash 30, 32 so that they will remain in a position desired by the user. This frictional force is generated by forming a pair of spring hinges 88, 89 on the jamb liner 24, between the tracks 65, 69 and the wall 22 of the jamb 14. Each of the spring hinges comprises an elongated strip integrally formed with the tracks, and extending over their entire length. Optimally, the spring hinges 88, 89 are coextruded with the entirety of the jamb liner 24.

In prior art window assemblies, an upper rail of the sliding sash is released from the jamb liner by manually forcing the jamb liner laterally outwardly so that a projection on the sash can be deflected laterally inwardly from a jamb liner channel in which the projection is seated. After one projection is released from its channel, a second projection on the opposite lateral side is released by a similar procedure. When both projections are released, the sash is tilted by pulling the upper rail toward the interior while the lower rail is fixed in position by the tilt lock mechanism. The window assembly is thereby deflected into a position where an exterior pane of the sash glazing is accessible for cleaning. Although the prior art window assembly just described is capable of operating in accordance with its intended purpose, some users have experienced difficulty in applying sufficient manual force to deflect the jamb liners laterally outwardly. Accordingly, there is a need for the tilt window assembly of the present invention wherein reduced manual force is needed to deflect the jamb liners laterally outwardly.

Figure 8:
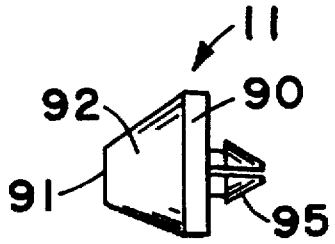
FIG. 8 is a top plan view of the tilt assist embossment of FIG. 6.
Figure 6:
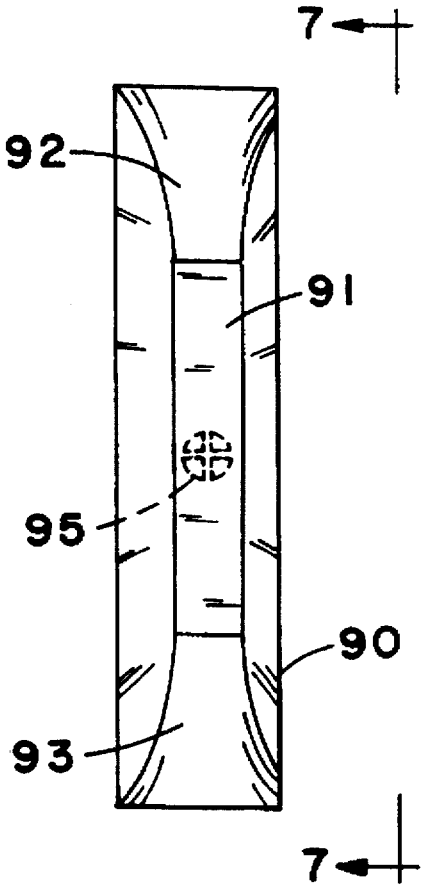
FIG. 6 is a front elevational view of a tilt assist embossment of the invention.
Figure 7:
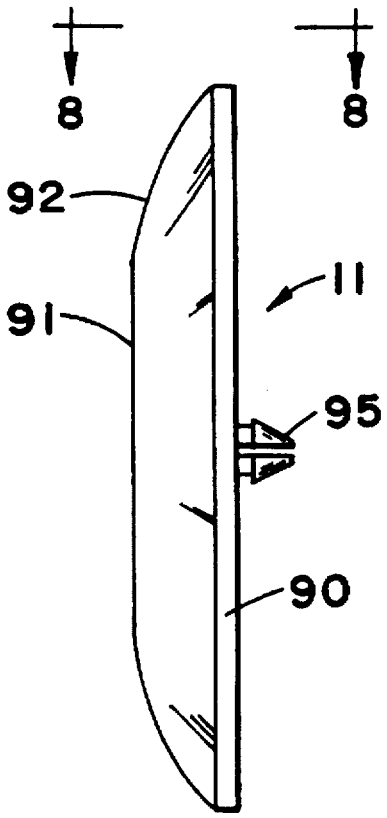
FIG. 7 is a side elevational view of the tilt assist embossment of FIG. 6.

The foregoing difficulties of prior art window assemblies are obviated in the window assembly described herein by providing a tilt assist device comprising the embossment 11 shown in FIGS. 6–8. The embossment 11 is preferably molded from nylon, and it includes an outer wall portion or outer wall 90; an inner wall portion or inner wall 91; a top ramp 92 connecting a top portion of the inner wall 91 to a top portion of the outer wall 90; and a bottom ramp 93 connecting a bottom portion of the inner wall 91 to a bottom portion of the outer wall 90. A through fastener includes a post 95 that is preferably formed integrally with the outer wall 90.

Referring now to FIGS. 2A and 4, the nylon embossment 11 is affixed to an outer wall 76 of a channel 75 formed in the jamb liner 24. A through fastener formed integrally with the embossment 11 includes a post 95 extending through an opening 97 in the outer wall 76 and attached to that wall by a snap fit. The embossment inner wall 91 is situated laterally inwardly of the side wall 70 in the jamb liner 24.

Figure 2B:
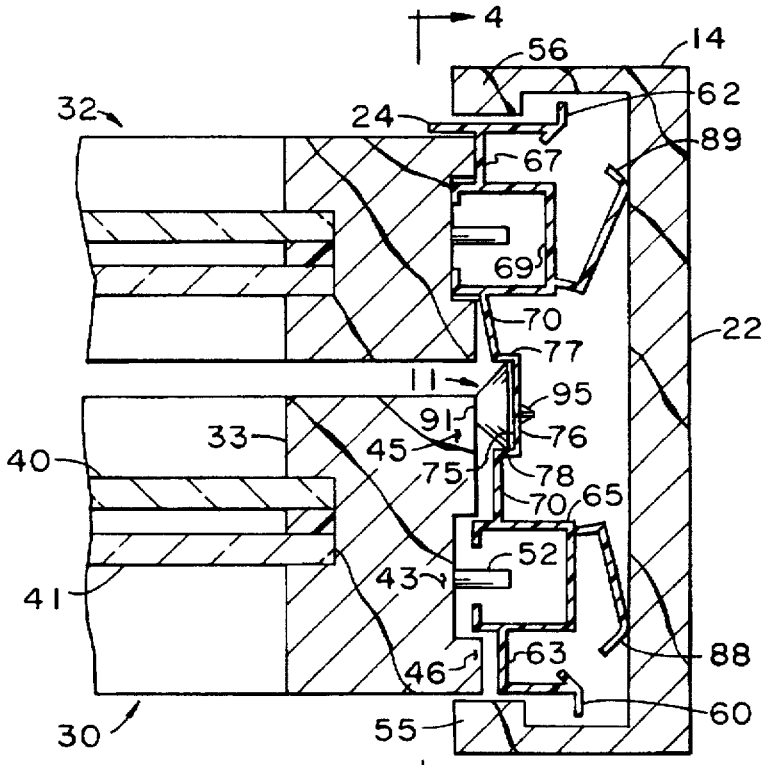
FIG. 2B is a fragmentary cross-sectional view of the window assembly of FIG. 2A, after the lower sash has been elevated.
Figure 3:
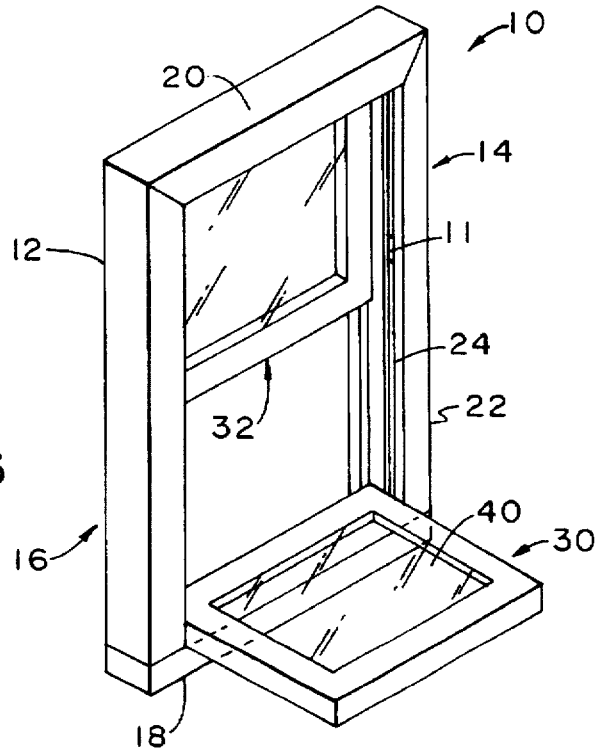
FIG. 3 is a perspective view of a tilt window assembly of the invention, with the lower sash tilted interiorly.

Raising the lower sash 30 elevates the exterior projection 45 on the lower sash 30 to a position opposite the embossment 11, as shown in FIG. 2B. The projection 45 abuts with the embossment inner wall 91, thereby forcing the jamb liner 24 laterally outward so that the hinges 88, 89 are compressed against the jamb 14. As a result, the upper rail 36 is more easily forced interiorly by manual force than in prior art assemblies having no tilt assist embossment. The window assembly 10 shown in FIG. 3 illustrates a desired position of the lower sash 30 for cleaning the exterior glazing pane 40.

The foregoing description of our invention has been made with reference to one particularly preferred embodiment. Persons skilled in the art know that numerous modifications can be made therein without departing from the spirit and scope of the following claims.

What is claimed is:

1. A tilt window assembly comprising:

(a) a window frame having a pair of opposed jambs each comprising a flexible jamb liner having a side wall and an elongated channel having an outer wall spaced laterally outwardly of said side wall;

(b) at least one sliding sash comprising a sash frame including a side portion and a projection extending laterally outwardly of said side portion into said channel;

(c) a tilt lock mechanism connecting said jambs and said sliding sash; and (d) a tilt assist embossment attached to said channel and extending laterally inwardly of said outer wall, said embossment reacting to contact with said projection by flexing said jamb liner laterally outwardly, thereby to assist unlocking of said projection from said channel so that said sash may be tilted interiorly of said jamb liner.

2. The window assembly of claim 1 wherein said jamb liners each comprise a flexible polymeric material.

3. The window assembly of claim 1 wherein said jamb liners comprise vinyl extrusions.

4. The window assembly of claim 1 wherein said embossment comprises nylon.

5. The window assembly of claim 1 wherein said embossment is attached to said outer wall.

6. The window assembly of claim 1 wherein said outer wall defines a through opening and said embossment includes a fastener extending into said opening.

7. The window assembly of claim 6 wherein said fastener is formed integrally with said embossment.

8. The window assembly of claim 1 wherein said frame includes upper and lower rails joined by a pair of stiles, at least one said stiles including a side portion and said projection extends laterally outwardly of said side portion.

9. The window assembly of claim 8 wherein said window frame includes a generally horizontally extending sill, said jambs extend outwardly of said sill, and said lower rail is adjacent said sill when said sliding sash is closed.

10. The window assembly of claim 8 wherein said embossment is spaced upwardly of said upper rail.

11. A tilt window assembly comprising:

(a) a window frame comprising a pair of opposed laterally spaced generally vertical jambs each including an extruded polymeric jamb liner having a side wall, said jamb liner defining a channel having an outer wall spaced laterally outward of said side wall;

(b) a lower sliding sash including a side portion and a projection extending laterally outward of said side portion, said lower sash including upper and lower rails extending generally horizontally;

(c) a tilt lock mechanism connecting said jamb liners and said sliding sash; and (d) a tilt assist embossment attached to said jamb liner and extending laterally inwardly of said side wall, said embossment being spaced upwardly of said upper rail when said lower sliding sash is closed, said embossment flexing said jamb liner laterally outwardly in response to contact with said projection.

12. A flexible jamb liner for a tilt window assembly comprising:

(a) an elongated, flexible polymeric extrusion having a side wall and an elongated channel formed integrally with said side wall and having an outer wall spaced laterally outwardly of said side wall; and (b) a tilt assist embossment attached to said outer wall by a post extending through an opening in said outer wall, said embossment assisting unlocking of a window sash from said channel by flexing said jamb liner laterally outwardly upon contact with a projection extending from said window sash.

13. The jamb liner of claim 12 wherein said polymeric extrusion comprises a vinyl extrusion and said embossment comprises nylon.

14. The jamb liner of claim 12 wherein said post is formed integrally with said embossment.

* * * * *